US009556547B1

(12) United States Patent
Hayasaka

(10) Patent No.: US 9,556,547 B1
(45) Date of Patent: Jan. 31, 2017

(54) SEWING MACHINE THAT IS CAPABLE OF DETECTING SEWING TARGET FEEDING LENGTH

(71) Applicant: Janome Sewing Machine Co., Ltd., Tokyo (JP)

(72) Inventor: Ayuko Hayasaka, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 15/205,600

(22) Filed: Jul. 8, 2016

(30) Foreign Application Priority Data

Aug. 3, 2015 (JP) ..... 2015-153371

(51) Int. Cl.
*D05B 29/02* (2006.01)
*D05B 3/24* (2006.01)
*D05B 3/06* (2006.01)

(52) U.S. Cl.
CPC ..... *D05B 29/02* (2013.01); *D05B 3/06* (2013.01); *D05B 3/24* (2013.01)

(58) Field of Classification Search
CPC ..... D05B 29/02; D05B 3/06; D05B 3/24
See application file for complete search history.

(56) References Cited

U.S. PATENT DOCUMENTS 3,596,618 A * 8/1971 Goldbach ..... D05B 3/06 112/446
3,656,443 A * 4/1972 Ross ..... D05B 3/24 112/235
4,182,249 A * 1/1980 Matumura ..... D05B 3/24 112/447
4,216,732 A * 8/1980 Marsh ..... D05B 3/24 112/447
4,242,976 A * 1/1981 Beckerman ..... D05B 3/24 112/475.25
4,393,797 A * 7/1983 Marsh ..... D05B 3/06 112/447
4,458,612 A * 7/1984 Asai ..... D05B 3/08 112/447
4,622,910 A * 11/1986 Hangarter ..... D05B 3/24 112/447
4,953,486 A * 9/1990 Sano ..... D05B 3/06 112/235

(Continued)

FOREIGN PATENT DOCUMENTS

JP H07-61389 B2 7/1995
JP 3151923 B2 4/2001

*Primary Examiner* — Danny Worrell
(74) *Attorney, Agent, or Firm* — Nakanishi IP Associates, LLC

(57) ABSTRACT

A sewing machine can detect a sewing target feeding length, and includes: a presser rod, a presser main body detachably mounted on the presser rod, a movable presser portion mounted on the presser main body such that it can be pressed in contact with a sewing target in the sewing operation, and such that it is movable with the sewing target in feeding and reverse feeding directions; a movement transmission portion configured having one end that can be coupled with the movable presser portion, and having an other end that receives a position change of the one end; a slide volume that detects the position change of the other end, and a calculation unit that calculates the position change of the movable presser portion based on the detection result obtained by the slide volume.

3 Claims, 8 Drawing Sheets

(56) References Cited

U.S. PATENT DOCUMENTS

| | | | | | |
|---|---|---|---|---|---|
| 5,099,775 | A * | 3/1992 | Jimenez | D05B 27/22 | 112/277 |
| 5,899,157 | A * | 5/1999 | Kurono | D05B 29/02 | 112/239 |
| 7,878,132 | B2 * | 2/2011 | Asaba | D05B 3/06 | 112/110 |
| 8,701,577 | B2 * | 4/2014 | Tseng | D05B 29/02 | 112/235 |

* cited by examiner

SEWING MACHINE THAT IS CAPABLE OF DETECTING SEWING TARGET FEEDING LENGTH

This application is based on and claims the benefit of priority to Japanese Patent Application No. 2015-153371 filed on Aug. 3, 2015, the contents of which are hereby incorporated by reference in their entirety.

BACKGROUND

Field of the Invention

The present invention relates to a sewing machine that is capable of detecting the feeding length to which a sewing target has been fed.

Description of Related Art

In order to carry out automatic sewing of a buttonhole, there is a need to reverse the sewing direction immediately after carrying out sewing for a suitable length that corresponds to the size of the button.

Patent document 1 discloses a sewing machine including a presser provided with a detection apparatus that generates a variable output signal so as to detect the length of sewing that has been carried out.

Also, Patent document 2 discloses a sewing machine including a presser provided with a distance detection apparatus including a rotatable member so as to detect the movement of a sewing target in increments of steps.

Furthermore, a casing of the sewing machine mounts an optical detection apparatus that detects the rotation of the rotatable member in an optical manner. Such an arrangement is capable of detecting the length of sewing that has been carried out.

RELATED ART DOCUMENTS

Patent Documents

[Patent document 1]

Japanese Patent No. 3,151,923

[Patent document 2]

Japanese Examined Patent Publication No. H07-61389

SUMMARY OF INVENTION

However, with the technique disclosed in Patent document 1, such an arrangement requires an electrical mechanism that provides communication from the detection apparatus provided to the presser to the sewing machine main body. That is to say, such an arrangement requires a presser having a complicated configuration, leading to an increase in the cost of the presser.

With the technique disclosed in Patent document 2, such an arrangement does not require an electrical connection between the presser and the sewing machine main body. However, there is a need to provide the presser with a mechanical transmission apparatus that transmits, to the rotatable member, the movement of an engagement member that moves together with a sewing target, in addition to the rotatable member. Accordingly, with the technique disclosed in Patent document 2, such an arrangement requires a presser having a large size and a complicated configuration, resulting in an increase in the cost.

In order to solve such a problem, it is a purpose of the present invention to provide a sewing machine having a simple configuration so as to detect the feeding length to which a feeding target has been fed.

With at least one embodiment of the present invention, such an arrangement solves the aforementioned problems as described below.

(1) At least one embodiment of the present invention relates to a sewing machine that is capable of detecting a sewing target feeding length. The sewing machine comprises: a presser rod having one end coupled with a sewing machine main body; a presser main body mounted on the other end of the presser rod; a movable presser portion that is mounted on the presser main body, and that is arranged such that it can be pressed in contact with a sewing target and such that it can be moved in a feeding direction in which the sewing target is fed; a movement transmission portion configured to have one end that can engage with the movable presser portion, and that moves according to a movement of the movable presser portion, and to have the other end that moves within the sewing machine main body according to the movement of the sewing target in the feeding direction; a detection unit that is included in the sewing machine main body, and that detects a change in position of the other end of the movement transmission portion due to a movement of the one end of the movement transmission portion; and a calculation unit that calculates a change in position of the movable presser portion based on a detection result obtained by the detection unit.

(2) At least one embodiment of the present invention also relates to a sewing machine that is capable of detecting a sewing target feeding length. Also, the movement transmission portion may directly transmit the change in position of the one end of the movement transmission portion in the sewing target feeding direction to the other end of the movement transmission portion without conversion. Also, the detection unit may detect the change in position of the other end of the movement transmission portion in the sewing target feeding direction.

(3) At least one embodiment of the present invention also relates to a sewing machine that is capable of detecting a sewing target feeding length. Also, the detection unit may detect a rotational change in position of the other end of the movement transmission portion.

With at least one of the aforementioned embodiments of the present invention, such an arrangement provides a sewing machine having a simple configuration that is capable of detecting the sewing target feeding length. Specifically, by providing the sewing machine main body with a detection unit that detects the sewing target feeding length, such an arrangement solves various kinds of problems such as a problem of the presser member having a large size and/or a complicated configuration, and a problem of an increased cost.

DETAILED DESCRIPTION

Description will be made below with reference to the drawings and the like regarding an ideal embodiment for providing the present invention.

First Embodiment

Figure 1:
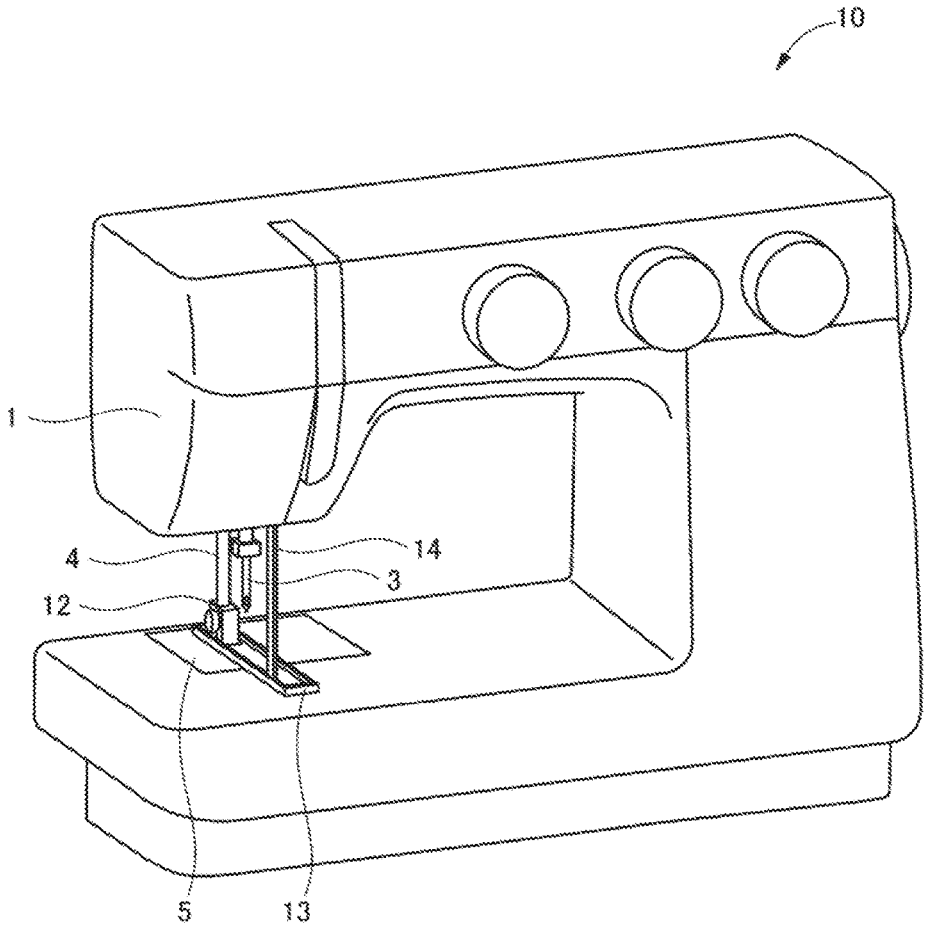
FIG. 1 is a diagram showing a sewing machine that is capable of detecting the feeding length according to the first through fifth embodiments of the present invention.

FIG. 1 is a diagram showing a sewing machine that is capable of detecting a feeding length according to the present embodiment.

Figure 2:
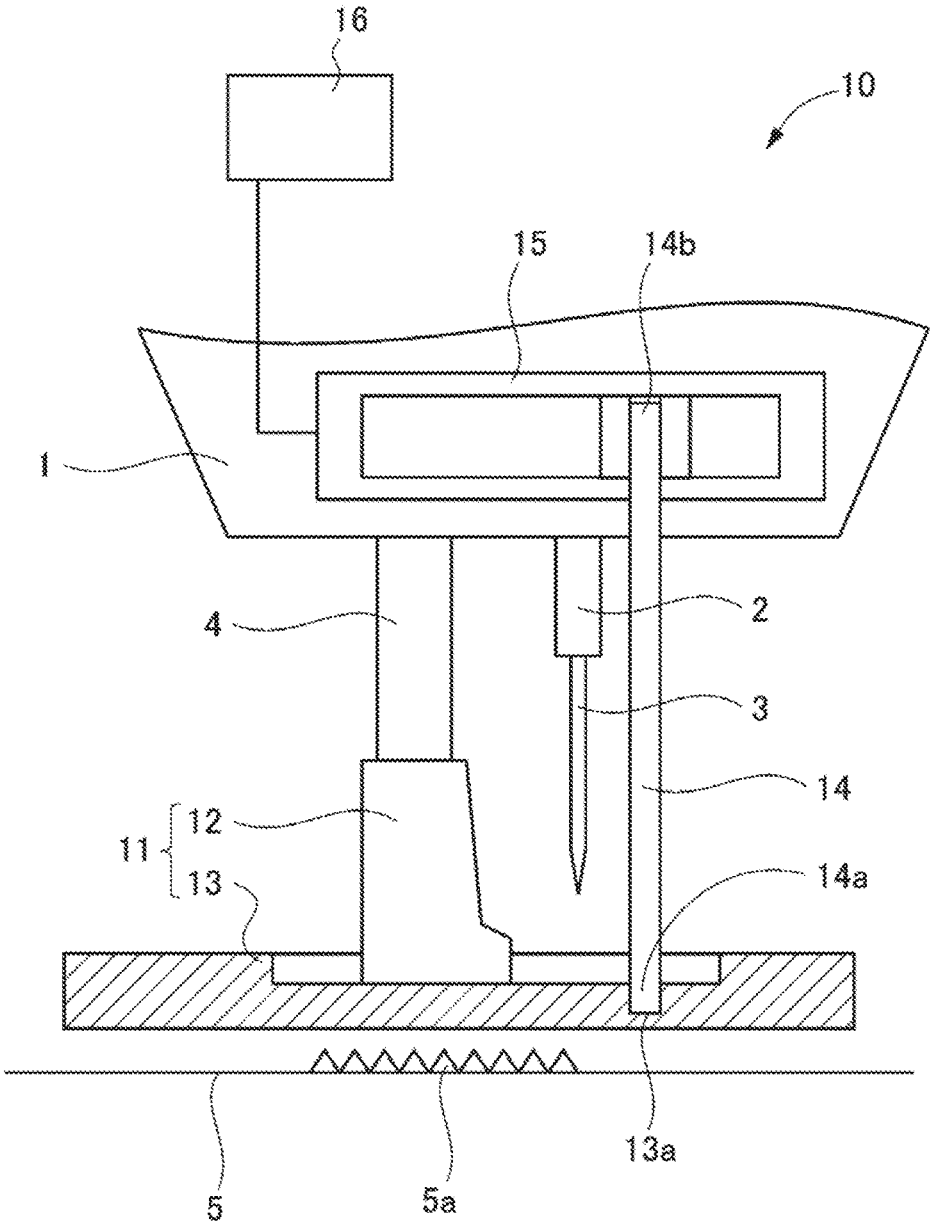
FIG. 2 is a diagram showing a sewing machine that is capable of detecting the feeding length according to the first embodiment of the present invention.

FIG. 2 is a diagram showing the sewing machine that is capable of detecting a feeding length according to the present embodiment.

It should be noted that the following drawings including FIGS. 1 and 2 each show a schematic configuration. For ease of understanding, each component is shown with a different size or different shape for emphasis as appropriate.

Also, description will be made below regarding an arrangement with specific values, shapes, materials, etc. However, such factors may be changed as appropriate.

A sewing machine 10 according to a first embodiment includes a sewing machine main body 1, a needle bar 2, a needle 3, a presser rod 4, a needle plate 5, a buttonhole presser 11, a movement transmission portion 14, a slide volume 15, and a calculation unit 16.

The sewing machine main body 1 is configured as a principal unit of the sewing machine 10, including an unshown motor, a driving mechanism that drives the needle bar 2, an operating portion, and the like.

The needle bar 2 mounts the needle 3 at its end. The needle bar 2 can be driven in a reciprocal manner along the vertical direction by means of a driving force provided by an unshown motor.

A thread is applied to the needle 3 such that it passes through an unshown needle opening. The needle 3 is reciprocally driven together with the needle bar in the vertical direction.

The buttonhole presser 11 is mounted on the presser rod 4. Such an arrangement allows the user to operate the presser rod 4 so as to switch a state in which the presser rod 4 is lowered so as to press a cloth or the like and a state in which the presser rod 4 is raised such that it retracts upward.

The needle plate 5 is arranged above an unshown rotating hook. In the sewing operation, a cloth is set on the needle plate 5. The needle plate 5 includes a feed dog 5*a* exposed on its surface.

The buttonhole presser 11 includes a presser main body 12 and a movable presser portion 13.

The presser main body 12 is detachably mounted on the presser rod 4. The position of the presser main body 12 does not change with respect to the presser rod 4 and the sewing machine main body 1 regardless of whether or not sewing is performed.

The movable presser portion 13 is mounted on the presser main body 12 such that it can be pressed in contact with a sewing target such as a cloth or the like when sewing is performed, and such that it can be moved together with the sewing target in the feeding direction and the reverse feeding direction. The movable presser portion 13 is moved together with the sewing target in the horizontal direction in FIG. 2, i.e., in the feeding direction in which the feeding target is to be fed. It should be noted that, in order to provide improved contact between the movable presser portion 13 and the sewing target, a rough surface structure or otherwise an elastomer layer is preferably provided to the face of the movable presser portion 13 which is to be pressed in contact with the sewing target.

A recess 13*a* is provided to the upper face of the movable presser portion 13 so as to engage with the movement transmission portion 14.

The movement transmission portion 14 has one end 14*a* that can engage with the recess 13*a* formed in the movable presser portion 13. With the movement transmission portion 14, the one end 14*a* moves according to the movement of the movable presser portion 13 when cloth feeding is performed. According to this movement, the same amount of change as in the one end 14*a* occurs in the position of the other end 14*b* of the movement transmission portion 14 in the feeding direction in which the feeding target is fed.

Furthermore, with the first embodiment, the other end 14*b* of the movement transmission portion 14 is engaged with the slide volume 15 housed in the sewing machine main body 1.

The slide volume 15 is configured as a variable resister having a resistance value that changes according to the movement of the other end 14*b* of the movement transmission portion 14 in the feeding direction or otherwise in the reverse feeding direction. The slide volume 15 is provided within the sewing machine main body 1. The slide volume 15 functions as a detector that detects the movement of the other end 14*b*. The slide volume 15 is connected to the calculation unit 16.

Figure 3:
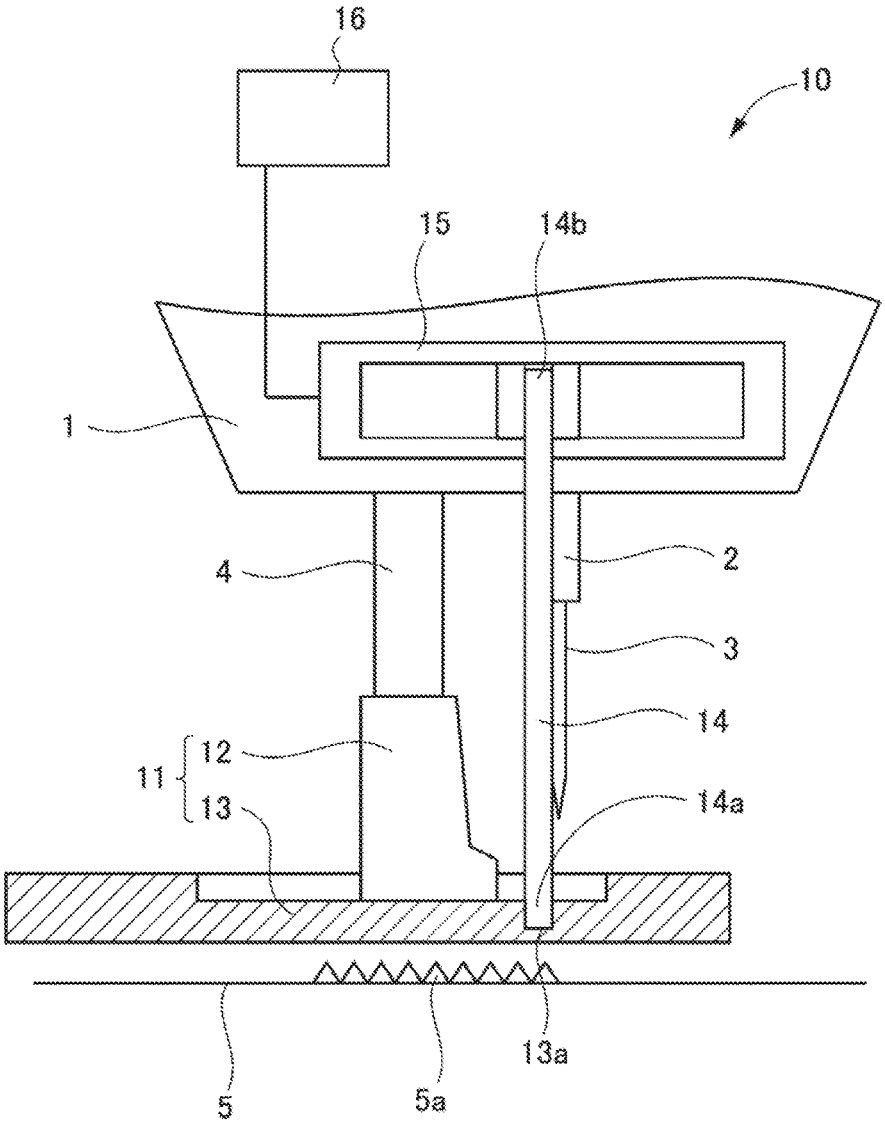
FIG. 3 is a diagram showing a state in which sewing has progressed from the state shown in FIG. 2.

FIG. 3 is a diagram showing a state in which sewing has progressed from the state shown in FIG. 2.

The position of the movable presser portion 13 changes according to the progress of the sewing. This also moves the movement transmission portion 14, which also changes the position of the other end 14*b* that is engaged with the slide volume 15.

The calculation unit 16 monitors the resistance value of the slide volume 15 for every predetermined time period. Furthermore, the calculation unit 16 calculates the change in position of the other end 14*b* of the movement transmission portion 14 based on the resistance value of the slide volume 15 thus monitored. With the present embodiment, the change in position of the other end 14*b* is equal to that of the movable presser portion 13. Thus, the calculation unit 16 is capable of calculating the change in position of the movable presser portion 13.

By calculating the change in position of the movable presser portion 13, an unshown sewing machine control unit is capable of automatically reversing the sewing direction immediately after the sewing ends for a length that corresponds to the length of a buttonhole set beforehand. That is to say, such an arrangement is capable of providing high-precision buttonhole sewing with a predetermined length.

Figure 4:
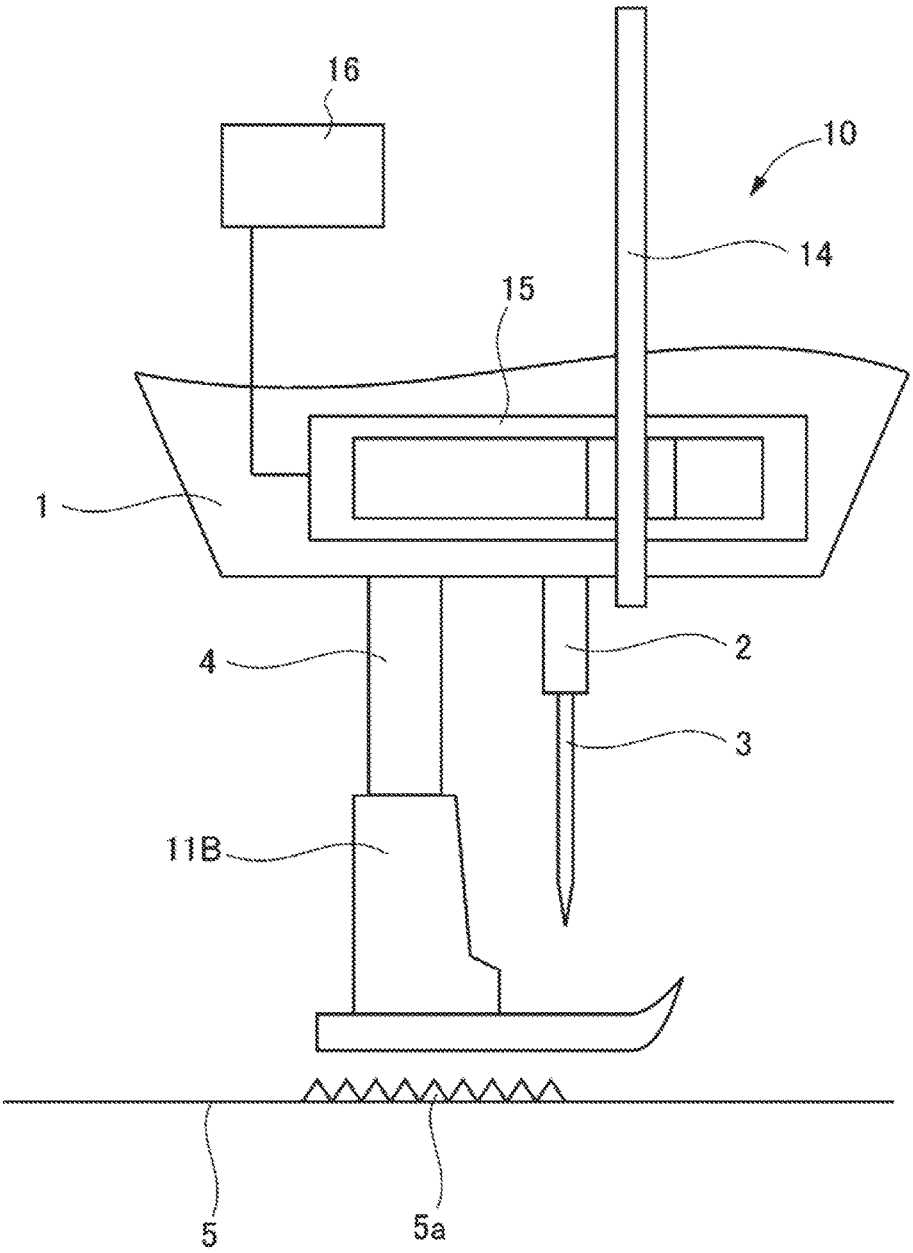
FIG. 4 is a diagram showing a state in which an ordinary sewing presser 11B is mounted instead of a buttonhole presser 11.

FIG. 4 is a diagram showing a state in which an ordinary sewing presser 11B is mounted instead of the buttonhole presser 11.

The movement transmission portion 14 is configured such that its one end 14*a* can be detachably engaged with the recess 13*a* formed in the movable presser portion 13. That is to say, in the ordinary sewing operation that does not require a function of detecting the feeding length, as shown in FIG. 4, such an arrangement allows the movement transmission portion 14 to be retracted such that it is housed within the sewing machine main body 1.

As described above, the first embodiment requires only a simple configuration to calculate the change in position of the movable presser portion 13, thereby allowing the sewing target feeding length to be detected. In particular, with the present embodiment, the movement transmission portion 14 transmits the same change in position of the one end 14*a* to the other end 14*b* without conversion. Furthermore, the other end 14*b* of the movement transmission portion 14 is directly engaged with the slide volume 15. Thus, such an arrangement allows the slide volume 15 to detect the change in position of the other end 14*b* without conversion. Thus, such an arrangement requires only a simple configuration to detect the change in position with high precision.

Furthermore, the slide volume 15 is included within the sewing machine main body. Thus, such an arrangement does not require the buttonhole presser 11 to have a complicated mechanism or the like. That is to say, such an arrangement allows the buttonhole presser 11 to have a simple configuration. Thus, such an arrangement allows the user to switch the state of the movable presser portion 13 in a simple manner when the buttonhole presser 11 is to be replaced by the ordinary sewing presser 11B or the like. Furthermore, such an arrangement provides an advantage in storing the buttonhole presser 11. Furthermore, such a simple configuration of the buttonhole presser 11 provides an advantage of a reduced risk of malfunction due to incorrect use by the user.

Second Embodiment

Figure 5:
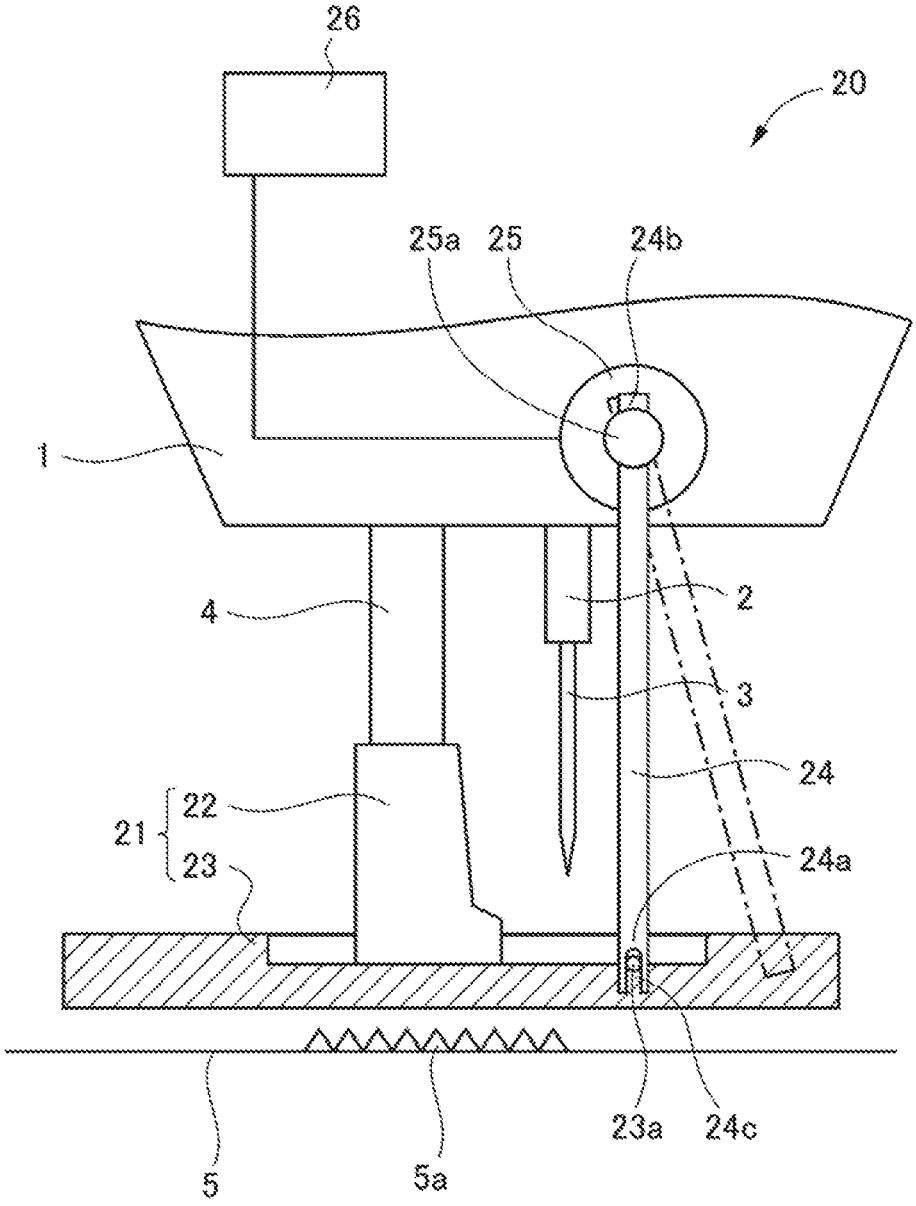
FIG. 5 is a diagram showing a sewing machine that is capable of detecting the feeding length according to a second embodiment of the present invention.

FIG. 5 is a diagram showing a sewing machine which is capable of detecting the feeding length according to the present embodiment.

It should be noted that a portion that provides the same function as that described in the first embodiment described above is denoted by the same reference symbol. Also, redundant description thereof will be omitted as appropriate.

A sewing machine 20 according to a second embodiment includes a sewing machine main body 1, a needle bar 2, a needle 3, a presser rod 4, a needle plate 5, a buttonhole presser 21, a movement transmission portion 24, a rotary encoder 25, and a calculation unit 26.

The buttonhole presser 21 includes a presser main body 22 and a movable presser portion 23.

The presser main body 22 is detachably mounted on the presser rod 4. The position of the presser main body 22 does not change with respect to the presser rod 4 and the sewing machine main body 1 regardless of whether or not sewing is performed.

The movable presser portion 23 is mounted on the presser main body 22 such that it can be pressed in contact with a sewing target such as a cloth or the like when sewing is performed, and such that it can be moved together with the sewing target in the feeding direction and the reverse feeding direction. The movable presser portion 23 is moved together with the sewing target in the horizontal direction in FIG. 5, i.e., in the feeding direction in which the feeding target is to be fed. It should be noted that, in order to provide improved contact between the movable presser portion 23 and the sewing target, a rough surface structure or otherwise an elastomer layer is preferably provided to the face of the movable presser portion 23 which is to be pressed in contact with the sewing target.

The movable presser portion 23 is provided with an engagement portion 23*a* so as to engage with the movement transmission portion 24. Furthermore, an engagement holder notch 24*c* is provided to one end 24*a* of the movement transmission portion 24 in order to maintain the engagement between the movement transmission portion 24 and the movable presser portion 23 regardless of whether or not the movable presser portion 23 is moved. That is to say, such an arrangement prevents the disengagement of the engagement portion 23*a* from the one end 24*a* due to the movement of the movable presser portion 23.

It should be noted that, in a case in which the movement transmission portion 24 has a sufficient length to ensure that the other end 24*b* of the movement transmission portion 24 does not disengage from a rotation detection shaft 25*a* of the rotary encoder 25 due to the movement of the movable presser portion 23 even if the one end 24*a* is engaged with the engagement portion 23*a* at a single point, such an arrangement does not require the movement transmission portion 24 to have the aforementioned engagement holder notch 24*c*.

The movement transmission portion 24 is configured such that the one end 24*a* can engage with the engagement portion 23*a* of the movable presser portion 23.

Furthermore, the movement transmission portion 24 according to the second embodiment is arranged such that the other end 24*b* thereof is mounted on the rotation detection shaft 25*a* of the rotary encoder 25. Such an arrangement allows the movable transmission portion 24 to turn with the rotation detection shaft 25*a* of the rotary encoder 25 as the center of rotation. Thus, when the movable presser portion 23 is moved, the rotation detection shaft 25*a* of the rotary encoder 25 turns together with the movement transmission portion 24 according to the change in position of the movable presser portion 23.

The rotary encoder 25 detects the rotation of the rotation detection shaft 25*a* that turns together with the other end 24*b* of the movement transmission portion 24. The rotary encoder 25 functions as a detector that detects the rotation of the other end 24*b*. The rotary encoder 25 is connected to the calculation unit 26. It should be noted that, in order to detect the feeding direction and the feeding length with high precision when the sewing target is fed, the rotary encoder 25 is preferably configured as an absolute position encoder that is capable of detecting both the rotational direction and the rotational position. However, the control unit of the sewing machine has information with respect to the feeding direction. Thus, the rotary encoder 25 may be configured as an incremental encoder.

The calculation unit 26 calculates the change in position of the movable presser portion 23 based on the rotation of the movement transmission portion 24 detected by the rotary encoder 25. The rotation thus detected by the rotary encoder 25 does not correspond to the change in position of the movable presser portion 23 in a one-to-one manner. Accordingly, the calculation unit 26 calculates the change in position of the movable presser portion 23 using a calculation expression, conversion table, or the like, prepared beforehand.

By calculating the change in position of the movable presser portion 23, an unshown sewing machine control unit is capable of automatically reversing the sewing direction immediately after the sewing ends for a length that corresponds to the length of a buttonhole set beforehand. That is to say, such an arrangement is capable of providing high-precision buttonhole sewing with a predetermined length.

As described above, the second embodiment employs the rotary encoder 25. Thus, such an arrangement does not require a large space to be provided to the sewing machine main body 1 side even if the movable presser portion 23 is movable in a wide range. This allows the sewing machine to have a compact size in a simple manner.

Third Embodiment

Figure 6:
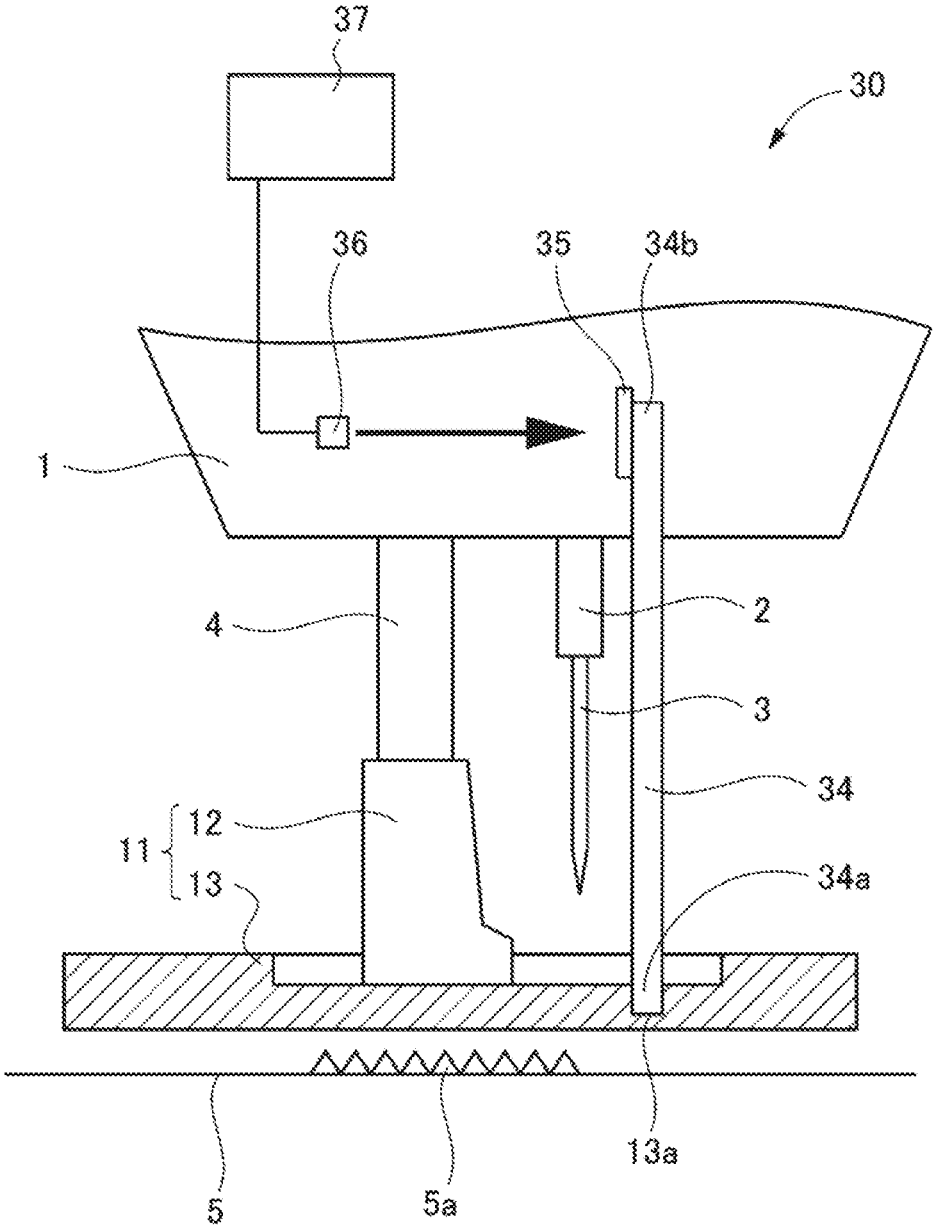
FIG. 6 is a diagram showing a sewing machine that is capable of detecting the feeding length according to a third embodiment of the present invention.

FIG. 6 is a diagram showing a sewing machine which is capable of detecting the feeding length according to the present embodiment.

It should be noted that a portion that provides the same function as that described in the first embodiment described above is denoted by the same reference symbol. Also, redundant description thereof will be omitted as appropriate.

A sewing machine 30 according to a third embodiment includes a sewing machine main body 1, a needle bar 2, a needle 3, a presser rod 4, a needle plate 5, a buttonhole presser 11, a movement transmission portion 34, a reflector plate 35, a laser displacement meter 36, and a calculation unit 37.

The movement transmission portion 34 has one end 34*a* that can be fitted to a recess 13*a* formed in a movable presser portion 13, in the same manner as with the movement transmission portion 14 according to the first embodiment. With the movement transmission portion 34, the one end 34*a* of the movement transmission portion 34 engaged with the movable presser portion 13 moves according to the movement of the movable presser portion 13 in the cloth feeding operation. According to this movement, the same change in position as that in the one end 34*a* occurs at the other end 34*b* of the movement transmission portion 34 in the feeding direction in which the sewing target is fed.

Furthermore, in the third embodiment, the reflector plate 35 is mounted on the other end 34*b* of the movement transmission portion 34. In the sewing machine main body 1, a rail (not shown) is arranged in the sewing target feeding direction and in the vertical direction. The other end 34*b* of the movement transmission portion 34 is engaged with the rail. This allows the movement transmission portion 34 to be moved in the sewing target feeding direction and to be housed within the sewing machine main body 1.

The reflector plate 35 is mounted on the other end 34*b* of the movement transmission portion 34. The reflector plate 35 reflects the laser light emitted from the laser displacement meter 36 such that it returns to the laser displacement meter 36.

The laser displacement meter 36 detects the laser light after it is emitted from the laser displacement meter 36 and returns from the reflector plate 35, so as to detect the displacement of the reflector plate 35. The laser displacement meter 36 functions as a detector that detects the change in position of the other end 34*b*. The laser displacement meter 36 is connected to the calculation unit 37.

The calculation unit 37 calculates the change in position of the other end 34*b* of the movement transmission portion 34 based on the detection result obtained by the laser displacement meter 36. With the present embodiment, the change in position of the other end 34*b* is the same as that of the movable presser portion 13. Thus, the calculation unit 37 is capable of calculating the change in position of the movable presser portion 13.

By calculating the change in position of the movable presser portion 13, an unshown sewing machine control unit is capable of automatically reversing the sewing direction immediately after the sewing ends for a length that corresponds to the length of a buttonhole set beforehand. That is to say, such an arrangement is capable of providing high-precision buttonhole sewing with a predetermined length.

As described above, with the third embodiment, by employing the laser displacement meter 36, such an arrangement is capable of detecting the change in position of the movement transmission portion 34 in a contactless manner in the sewing machine main body 1. This allows the load on the movable presser portion 13 to be reduced. Thus, such an arrangement provides the movable presser portion 13 with improved responsiveness with respect to the movement of the sewing target. Furthermore, with the present embodiment, the movement transmission portion 34 transmits the same change in position of the one end 34*a* to the other end 34*b* as it is and without conversion. The laser displacement meter 36 detects the displacement of the reflector plate 35 directly mounted on the other end 34*b* of the movement transmission portion 34. That is to say, the laser displacement meter 36 directly detects the change in position of the other end 34*b* without conversion. This allows the change in position to be detected with high precision using a simple configuration.

Fourth Embodiment

Figure 7:
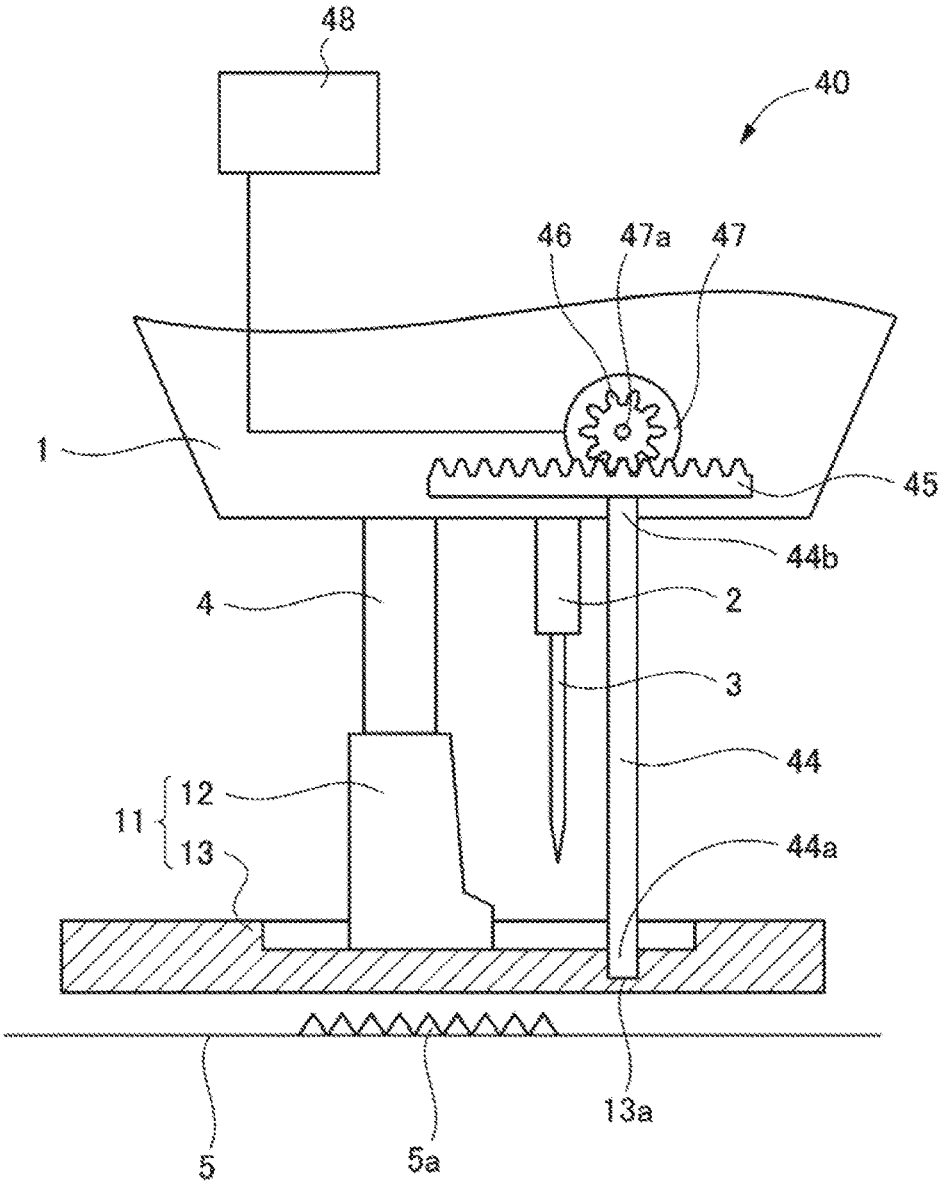
FIG. 7 is a diagram showing a sewing machine that is capable of detecting the feeding length according to a fourth embodiment of the present invention.

FIG. 7 is a diagram showing a sewing machine which is capable of detecting the feeding length according to the present embodiment.

It should be noted that a portion that provides the same function as that described in the first embodiment described above is denoted by the same reference symbol. Also, redundant description thereof will be omitted as appropriate.

A sewing machine 40 according to a fourth embodiment includes a sewing machine main body 1, a needle bar 2, a needle 3, a presser rod 4, a needle plate 5, a buttonhole presser 11, a movement transmission portion 44, a rack gear 45, a pinion gear 46, a rotary encoder 47, and a calculation unit 48.

The movement transmission portion 44 has one end 44*a* that can be fitted to a recess 13*a* formed in a movable presser portion 13, in the same manner as with the movement transmission portion 14 according to the first embodiment. With the movement transmission portion 44, the one end 44*a* of the movement transmission portion 44 engaged with the movable presser portion 13 moves according to the movement of the movable presser portion 13 in the cloth feeding operation. According to this movement, the same change in position as that in the one end 44*a* occurs at the other end 44*b* of the movement transmission portion 44 in the feeding direction in which the sewing target is fed.

Furthermore, in the fourth embodiment, the other end 44*b* of the movement transmission portion 44 is connected to the rack gear 45.

The rack gear 45 is connected to the other end 44*b* of the movement transmission portion 44 such that it can be moved in the sewing target feeding direction. Thus, the rack gear 45 moves according to the movement of the movement transmission portion 44.

The pinion gear 46 is mounted on a rotation detection shaft 47 of the rotary encoder 47 such that it is meshed with the rack gear 45. With such an arrangement, when the movement transmission portion 44 is moved, the pinion gear 46 rotates according to the movement of the movement transmission portion 44. This rotation is transmitted to the rotation detection shaft 47*a* of the rotary encoder 47.

The rack gear 45 and the pinion gear 46 function as a conversion mechanism that converts the movement of the other end 44*b* into rotation.

The rotary encoder 47 detects the rotation of the rotation detection shaft 47*a* that rotates according to the movement of the other end 44*b* of the movement transmission portion 44.

The rotary encoder 47 functions as a detector that detects the movement of the other end 44*b*. The rotary encoder 47 is connected to the calculation unit 48. It should be noted that, in order to detect the feeding direction and the feeding length with high precision when the sewing target is fed, the rotary encoder 47 is preferably configured as an absolute position encoder that is capable of detecting both the rotational direction and the rotational position. However, the control unit of the sewing machine has information with respect to the feeding direction. Thus, the rotary encoder 47 may be configured as an incremental encoder.

The calculation unit 48 calculates the change in position of the movable presser portion 13 based on the rotation of the rotation detection shaft 47*a* detected by the rotary encoder 47.

By calculating the change in position of the movable presser portion 13, an unshown sewing machine control unit is capable of automatically reversing the sewing direction immediately after the sewing ends for a length that corresponds to the length of a buttonhole set beforehand. That is to say, such an arrangement is capable of providing high-precision buttonhole sewing with a predetermined length.

As described above, with the fourth embodiment, such an arrangement is capable of detecting the change in position of the movable presser portion 13 by means of the rotary encoder 47 even if the movement transmission portion 44 is provided in a non-rotating form.

Fifth Embodiment

Figure 8:
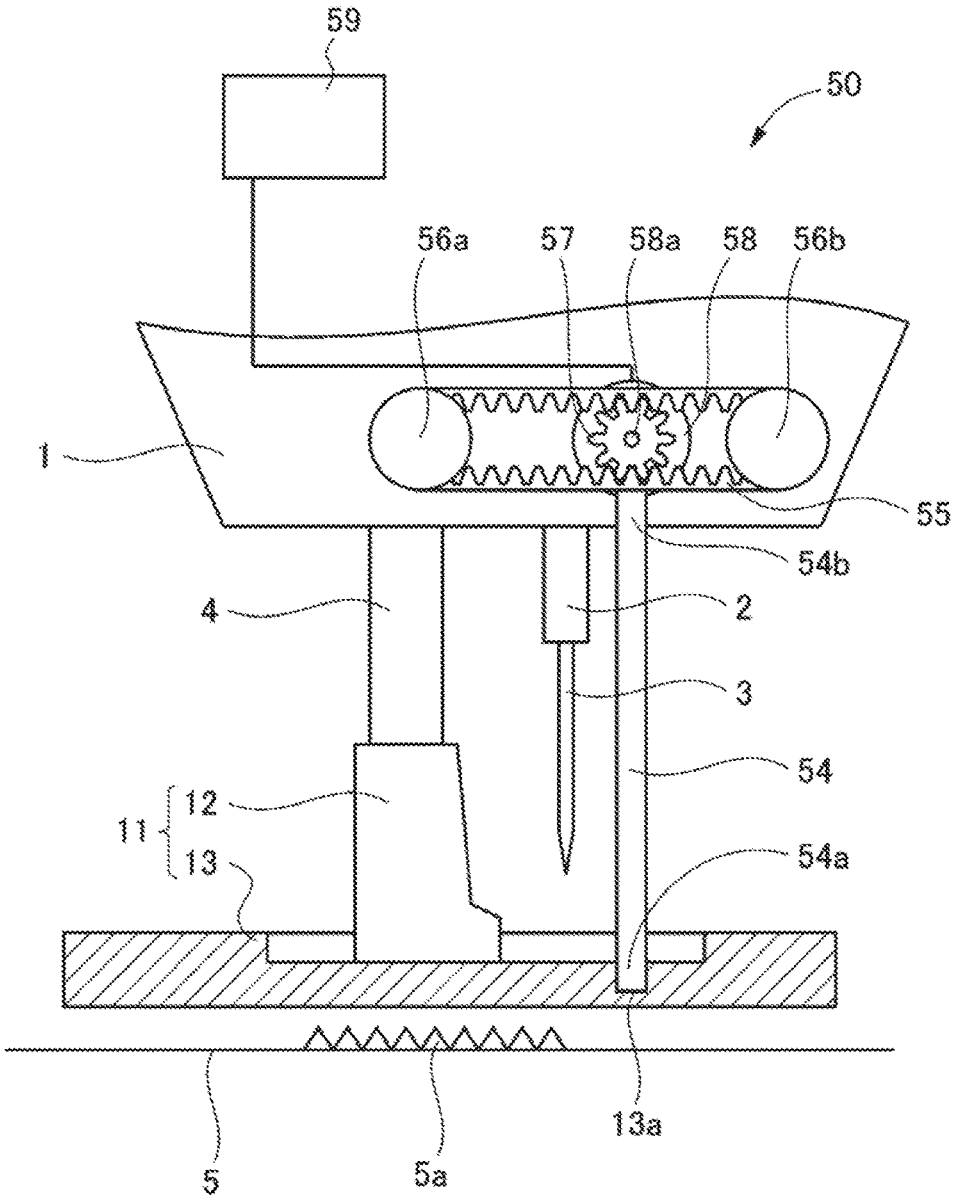
FIG. 8 is a diagram showing a sewing machine that is capable of detecting the feeding length according to a fifth embodiment of the present invention.

FIG. 8 is a diagram showing a sewing machine which is capable of detecting the feeding length according to the present embodiment.

It should be noted that a portion that provides the same function as that described in the first embodiment described above is denoted by the same reference symbol. Also, redundant description thereof will be omitted as appropriate.

A sewing machine 50 according to a fifth embodiment includes a sewing machine main body 1, a needle bar 2, a needle 3, a presser rod 4, a needle plate 5, a buttonhole presser 11, a movement transmission portion 54, a toothed belt 55, pulleys 56*a* and 56*b*, a gear 57, a rotary encoder 58, and a calculation unit 59.

The movement transmission portion 54 has one end 54*a* that can be fitted to a recess 13*a* formed in a movable presser portion 13, in the same manner as with the movement transmission portion 14 according to the first embodiment. With the movement transmission portion 54, the one end 54*a* of the movement transmission portion 54 engaged with the movable presser portion 13 moves according to the movement of the movable presser portion 13 in the cloth feeding operation. According to this movement, the same change in position as that in the one end 54*a* occurs at the other end 54*b* of the movement transmission portion 54 in the feeding direction in which the sewing target is fed.

Furthermore, in the fifth embodiment, the other end 54*b* of the movement transmission portion 54 is connected to the toothed belt 55.

The toothed belt 55 is stretched across the pulleys 56*a* and 56*b* such that they are connected via the toothed belt 55. Furthermore, the other end 54*b* of the movement transmission portion 54 is connected to a portion of the outer face of the toothed belt 55. With such an arrangement, the toothed belt 55 is driven and moved according to the movement of the movement transmission portion 54.

The gear 57 is mounted on the rotation detection shaft 58*a* of the rotary encoder 58 such that it is meshed with the toothed belt 55. With such an arrangement, when the movement transmission portion 54 is moved, the gear 57 rotates according to the movement of the movement transmission portion 54. The rotation is transmitted to the rotation detection shaft 58*a* of the rotary encoder 58.

The toothed belt 55, the pulleys 56*a* and 56*b*, and the gear 57 function as a conversion mechanism that converts the movement of the other end 54*b* into rotation.

The rotary encoder 58 detects the rotation of the rotation detection shaft 58*a* configured to rotate according to the movement of the other end 54*b* of the movement transmission portion 54. The rotary encoder 58 functions as a detector that detects the rotation of the other end 54*b*. The rotary encoder 58 is connected to the calculation unit 59. It should be noted that, in order to detect the feeding direction and the feeding length with high precision when the sewing target is fed, the rotary encoder 58 is preferably configured as an absolute position encoder that is capable of detecting both the rotational direction and the rotational position. However, the control unit of the sewing machine has information with respect to the feeding direction. Thus, the rotary encoder 58 may be configured as an incremental encoder.

The calculation unit 59 calculates the change in position of the movable presser portion 13 based on the rotation of the rotation detection shaft 58*a* detected by the rotary encoder 58.

By calculating the change in position of the movable presser portion 13, an unshown sewing machine control unit is capable of automatically reversing the sewing direction immediately after the sewing ends for a length that corresponds to the length of a buttonhole set beforehand. That is to say, such an arrangement is capable of providing high-precision buttonhole sewing with a predetermined length.

As described above, with the fifth embodiment, such an arrangement is capable of detecting the change in position of the movable presser portion 13 by means of the rotary encoder 58 even if the movement transmission portion 54 is provided in a non-rotating form.

It should be noted that, in the present specification and in the accompanying claims, for ease of understanding of the embodiments and specific examples of the invention, description has been made using specific terms, i.e., "the one end" and "the other end" of the movement transmission portion. However, the position represented by such terms is not restricted to an end position of such a member. Rather, "the one end" and "the other end" can be replaced by "the one side" and "the other side", respectively. Specifically, if the "the one end" of the movement transmission portion can be engaged with the movable presser portion, and if a detection unit can detect the change in position of the "the other end", this provides a function required in the first embodiment through the fifth embodiment. For example, in the first embodiment, if the other end 14*b* of the movement transmission portion 14 is engaged with the slide volume 15, this is effective in realizing its function. Accordingly, the movement transmission portion 14 may further have a portion that extends upward from the other end 14*b*.

[Modifications]

The present invention is not restricted to such embodiments as described above. Rather, various kinds of modifications and changes may be made, which are also encompassed within the technical scope of the present invention.

(1) Description has been made in the third embodiment regarding an example in which a laser displacement meter is employed to detect the change in position of the movement transmission portion in a contactless manner. However, the present invention is not restricted to such an arrangement. For example, a magnetic field detector may be employed to detect the change in position of the movement transmission portion in a contactless manner. Also, various kinds of other contactless detectors may be employed.

(2) Description has been made in the embodiments regarding an example employing a buttonhole presser. However, the present invention is not restricted to such an arrangement. Also, in addition to buttonhole sewing, the present invention is applicable to various kinds of other arrangements in order to detect a sewing target feeding length.

(3) Description has been made in the fifth embodiment regarding an example in which the gear 57 is arranged in addition to the pulleys 56*a* and 56*b*. However, the present invention is not restricted to such an arrangement. Also, either one from among the pulleys 56*a* and 56*b* may be directly mounted on the detection shaft of the rotary encoder.

It should be noted that the first through the fifth embodiments and the modifications thereof may be combined as appropriate. However, detailed description thereof will be omitted. The technical scope of the present invention is by no means restricted to the embodiments as described above.

REFERENCE SIGNS LIST

1 sewing machine main body
2 needle bar
3 needle
4 presser rod
5 needle plate
5*a* feed dog
10 sewing machine
11 buttonhole presser
11B ordinary sewing presser
12 presser main body
13 movable presser portion
13*a* recess
14 movement transmission portion
14*a* one end
14*b* the other end
15 slide volume
16 calculation unit
20 sewing machine
21 buttonhole presser
22 presser main body
23 movable presser portion
23*a* engagement portion
24 movement transmission portion
24*a* one end
24*b* the other end
24*c* engagement holder notch
25 rotary encoder
25*a* rotation detection shaft
26 calculation unit
30 sewing machine
34 movement transmission portion
34*a* one end
34*b* the other end
35 reflector plate
36 laser displacement meter
37 calculation unit
40 sewing machine
44 movement transmission portion
44*a* one end
44*b* the other end
45 rack gear
46 pinion gear
47 rotary encoder
47*a* rotation detection shaft
48 calculation unit
50 sewing machine
54 movement transmission portion
54*a* one end, 54*b* the other end
55 toothed belt
56*a* pulley
56*b* pulley
57 gear
58 rotary encoder
58*a* rotation detection shaft
59 calculation unit

What is claimed is:

1. A sewing machine that is capable of detecting a sewing target feeding length, comprising:

a presser rod having one end coupled with a sewing machine main body;

a presser main body mounted on the other end of the presser rod;

a movable presser portion that is mounted on the presser main body, and that is arranged such that it can be pressed in contact with a sewing target and such that it can be moved in a feeding direction in which the sewing target is fed;

a movement transmission portion configured to have an one end that can engage with the movable presser portion, and that moves according to a movement of the movable presser portion, and to have an other end that moves within the sewing machine main body according to the movement of the sewing target in the feeding direction;

a detection unit that is included in the sewing machine main body, and that detects a change in position of the other end of the movement transmission portion due to a movement of the one end of the movement transmission portion; and a calculation unit that calculates a change in position of the movable presser portion based on a detection result obtained by the detection unit.

2. The sewing machine according to claim 1, wherein the movement transmission portion directly transmits the change in position of the one end of the movement transmission portion in the sewing target feeding direction to the other end of the movement transmission portion without conversion, and wherein the detection unit detects the change in position of the other end of the movement transmission portion in the sewing target feeding direction.

3. The sewing machine according to claim 1, wherein the detection unit detects a rotational change in position of the other end of the movement transmission portion.

* * * * *